US010562746B2

(12) United States Patent
van Rooijen et al.

(10) Patent No.: US 10,562,746 B2
(45) Date of Patent: Feb. 18, 2020

(54) MAST SUPPORT DEVICE

(71) Applicant: Hyster-Yale Group, Inc., Fairview, OR (US)

(72) Inventors: Teun van Rooijen, Wageningen (NE); Sape Sikkema, Druten (NE); Paul Smulders, Nijmegen (NE)

(73) Assignee: HYSTER-YALE GROUP, INC., Fairview, OR (US)

( * ) Notice: Subject to any disclaimer, the term of this patent is extended or adjusted under 35 U.S.C. 154(b) by 268 days.

(21) Appl. No.: 15/795,131

(22) Filed: Oct. 26, 2017

(65) Prior Publication Data

US 2018/0118544 A1 May 3, 2018

Related U.S. Application Data

(60) Provisional application No. 62/414,184, filed on Oct. 28, 2016.

(51) Int. Cl.
*B66F 9/08* (2006.01)

(52) U.S. Cl.
CPC ..... *B66F 9/08* (2013.01)

(58) Field of Classification Search
CPC ..... B66F 9/08
See application file for complete search history.

(56) References Cited

U.S. PATENT DOCUMENTS 3,961,689 A * 6/1976 Leskovec ..... B66B 7/022 187/226
4,848,519 A * 7/1989 Ericson ..... B66B 9/04 187/272
5,657,834 A * 8/1997 Plaugher ..... B66F 9/08 187/226
6,505,710 B1 * 1/2003 Kato ..... B66F 9/08 187/226
7,523,808 B2 * 4/2009 Futamura ..... B66F 9/08 187/226
2002/0174766 A1 * 11/2002 Norton ..... B66F 9/22 92/82
2006/0027094 A1 * 2/2006 Schonauer ..... B66F 9/08 92/170.1
2013/0146396 A1 * 6/2013 Miwa ..... B66F 9/08 187/230
2014/0262626 A1 * 9/2014 Yahner ..... B66F 9/22 187/229
2015/0122585 A1 * 5/2015 Berns ..... B66F 9/07504 187/226
2018/0118544 A1 * 5/2018 van Rooijen ..... B66F 9/08

FOREIGN PATENT DOCUMENTS

DE 19849752 A1 5/2000
DE 102006053228 A1 5/2008
EP 1512662 A2 3/2005

OTHER PUBLICATIONS

European Search Report; EP App. No. 17198590.6; dated Mar. 27, 2018; pp. 1-7.

* cited by examiner

*Primary Examiner* — Michael A Riegelman
(74) *Attorney, Agent, or Firm* — Schwabe Williamson & Wyatt

(57) ABSTRACT

Embodiments herein relate to impact dampening blocks that may be located in footprints of channels of a mast. The impact dampening blocks may facilitate relief of at least some tension from a lift chain when a moveable member is lowered onto the impact dampening blocks. Other embodiments may be described and/or claimed.

20 Claims, 10 Drawing Sheets

MAST SUPPORT DEVICE

CROSS REFERENCE TO RELATED APPLICATIONS

The present application claims priority to U.S. Patent Application No. 62/414,184, filed Oct. 28, 2016, entitled "MAST SUPPORT DEVICE," the entire disclosure of which is hereby incorporated by reference in its entirety.

TECHNICAL FIELD

The present disclosure relates to masts for lift trucks, and in particular to devices for relieving lift chain tension for such masts.

SUMMARY

The present inventors have recognized that lift chains on certain lift truck masts are typically under constant, or nearly constant, tension. For example, when the mast is not fully lowered with an attachment resting on the ground, the lift chains may be under constant tension. For some lift trucks in certain applications, such as empty container handling, the lift chains rarely, if ever, are relieved from being tensioned. Some lift truck lift chains therefore carry a relatively large proportion of the rated load for a lift truck, even when not lifting a load, because of the construction, kinematics, dimensions, and weight of attachments secured to the mast.

The present inventors have also recognized that maintaining lift chains under constant, or nearly constant, tension may inhibit effective lubrication of such chains. The present inventors have also recognized that maintaining lift chains under constant, or nearly constant, tension typically reduces lift chain life.

DETAILED DESCRIPTION

Figure 1:
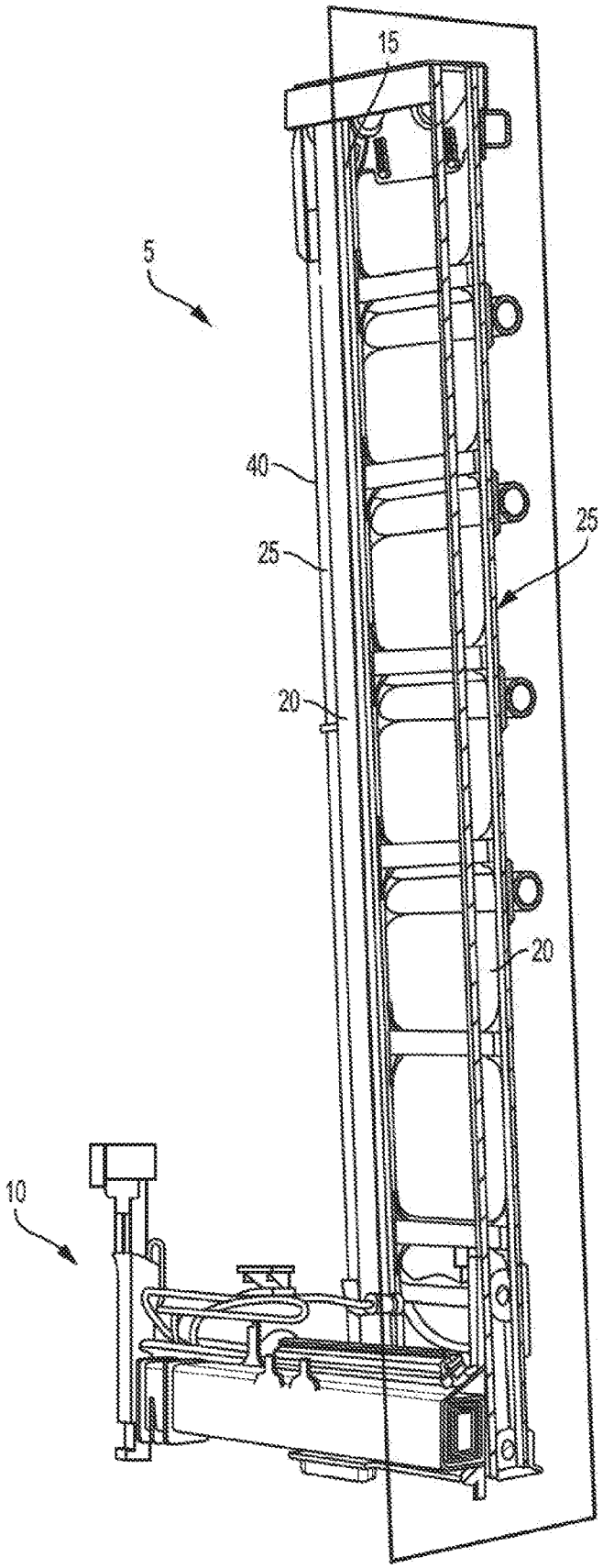
FIG. 1 is a front, left orthogonal sectional view of an example two-stage mast including impact dampening blocks.

With reference to FIG. 1, a two-stage mast 5 may carry a moveable member, such as empty container handling attachment 10, which is vertically translatable along the two-stage mast 5 via one or more lift chains 15. The empty container handling attachment 10 may be constrained in channels 20 that are formed in mast columns 25. The moveable member may be other suitable attachments.

Figure 2:
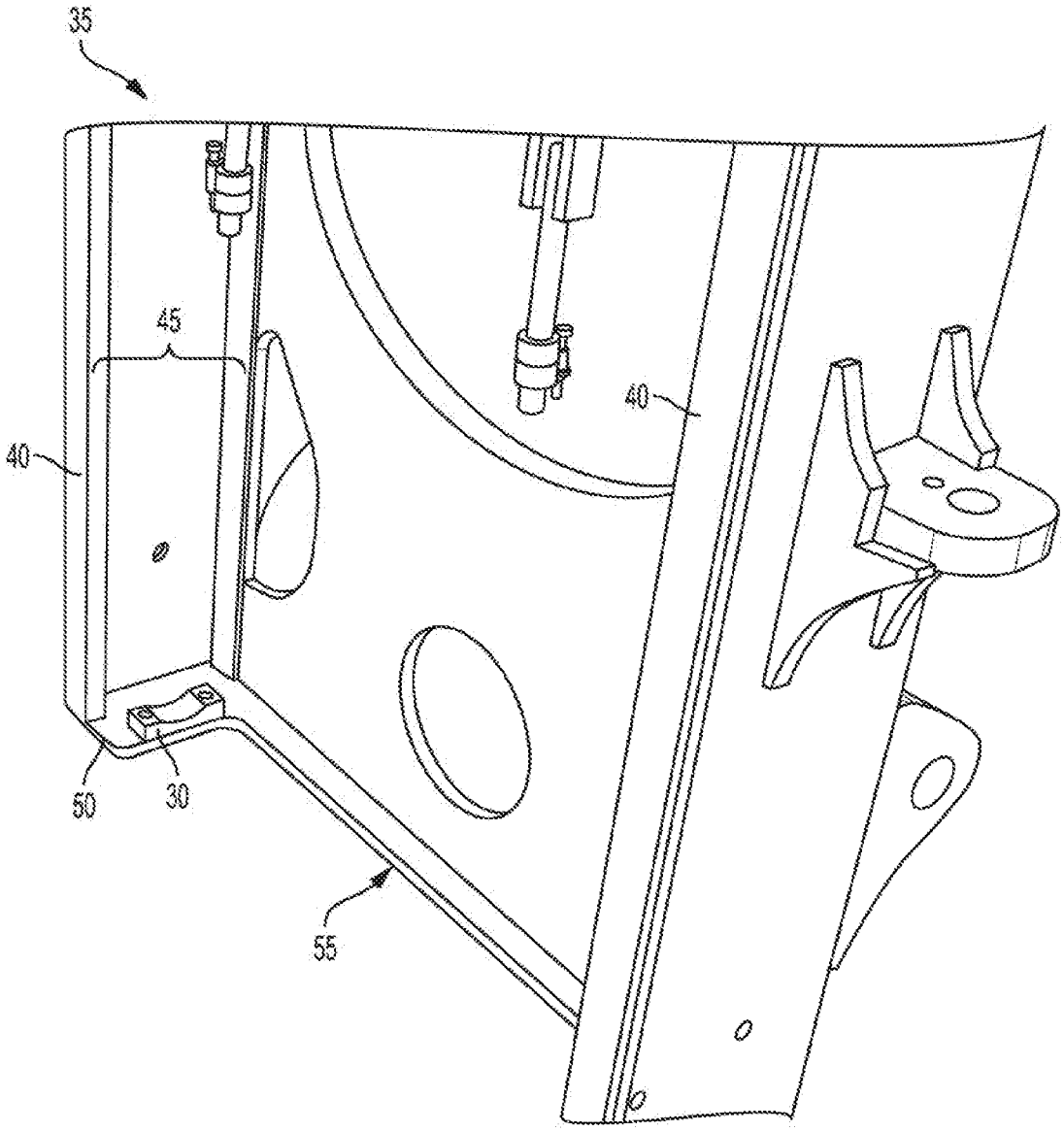
FIG. 2 is a view of the bottom portion of FIG. 1 with the inner mast stage removed.
Figure 3:
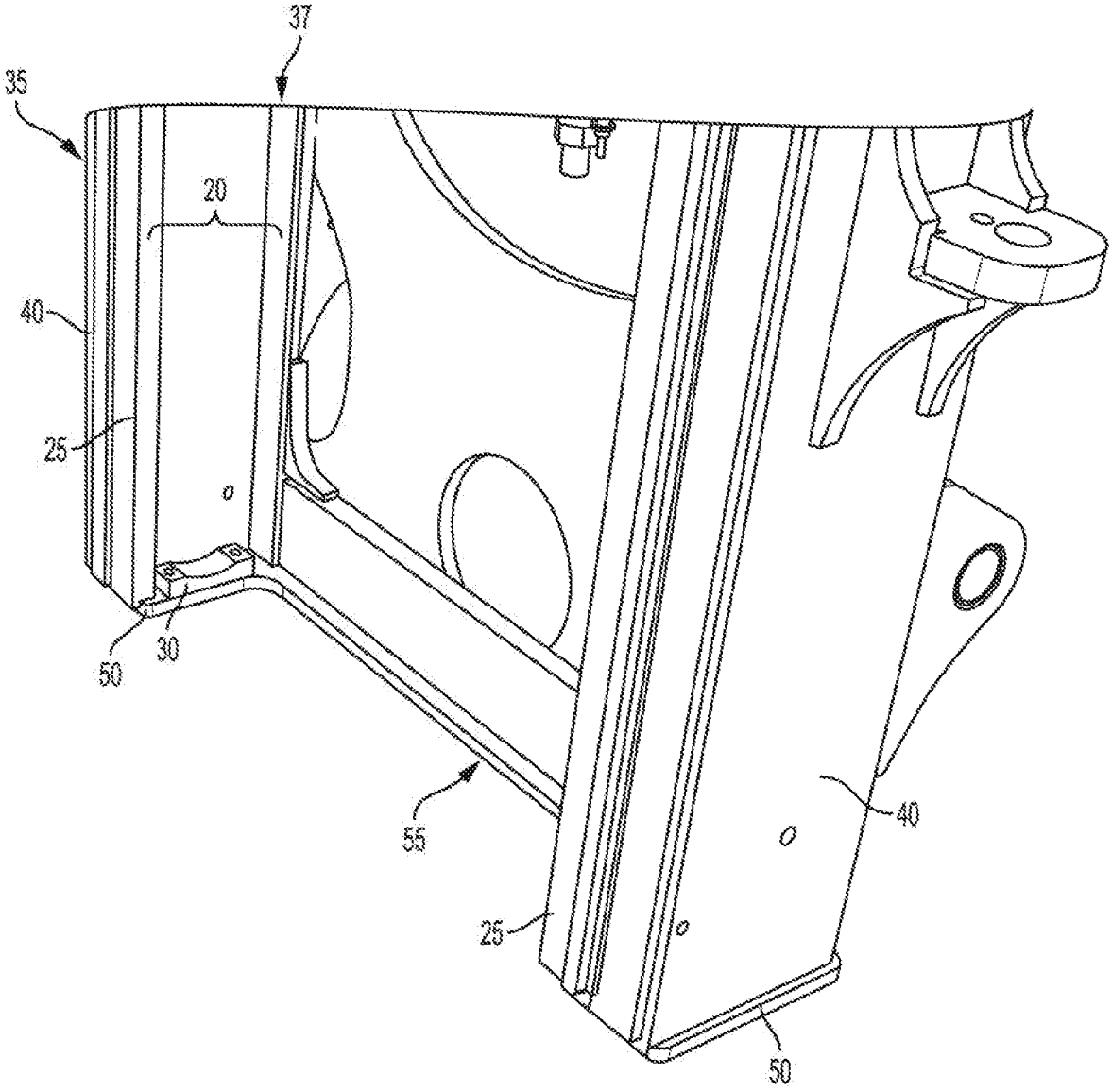
FIG. 3 is a view of the bottom portion of FIG. 1 with the inner mast stage illustrated.

With reference to FIGS. 1-4, an impact dampening block 30 may be located proximate to the bottom of an outer mast section 35. Only one impact dampening block 30 is illustrated in FIG. 2 proximate one of the mast columns 40, however an identical impact dampening block 30 is included proximate the other mast column 40. Each mast column 40 includes a channel 45 formed therein. Optionally, each impact dampening block 30 may be located proximate an end of a channel 45 that is proximate to the ground such that each dampening block 30 is aligned with a center of its corresponding channel 45. The dampening blocks 30 may not be contained within the footprint of channel 45, but may be offset such that each dampening block 30 is contained, at least partially, within the footprint of channel 20 (FIG. 3). Optionally, impact dampening blocks 30 may be secured to end caps 50. In the embodiment illustrated in FIG. 2, end caps 50 are formed as part of plate 55 that is secured to the outer mast section 35, via welding, for example. In the embodiment illustrated in FIG. 2, the impact dampening blocks 30 are bolted to the end caps 50, however, other suitable manners for securing the impact dampening blocks 30 may be used, for example, adhesives. Optionally, impact dampening blocks, such as impact dampening blocks 30, may be secured within a footprint of a channel other than by being secured to an end cap, for example, by being secured to one of the walls forming channel 20.

Figure 4:
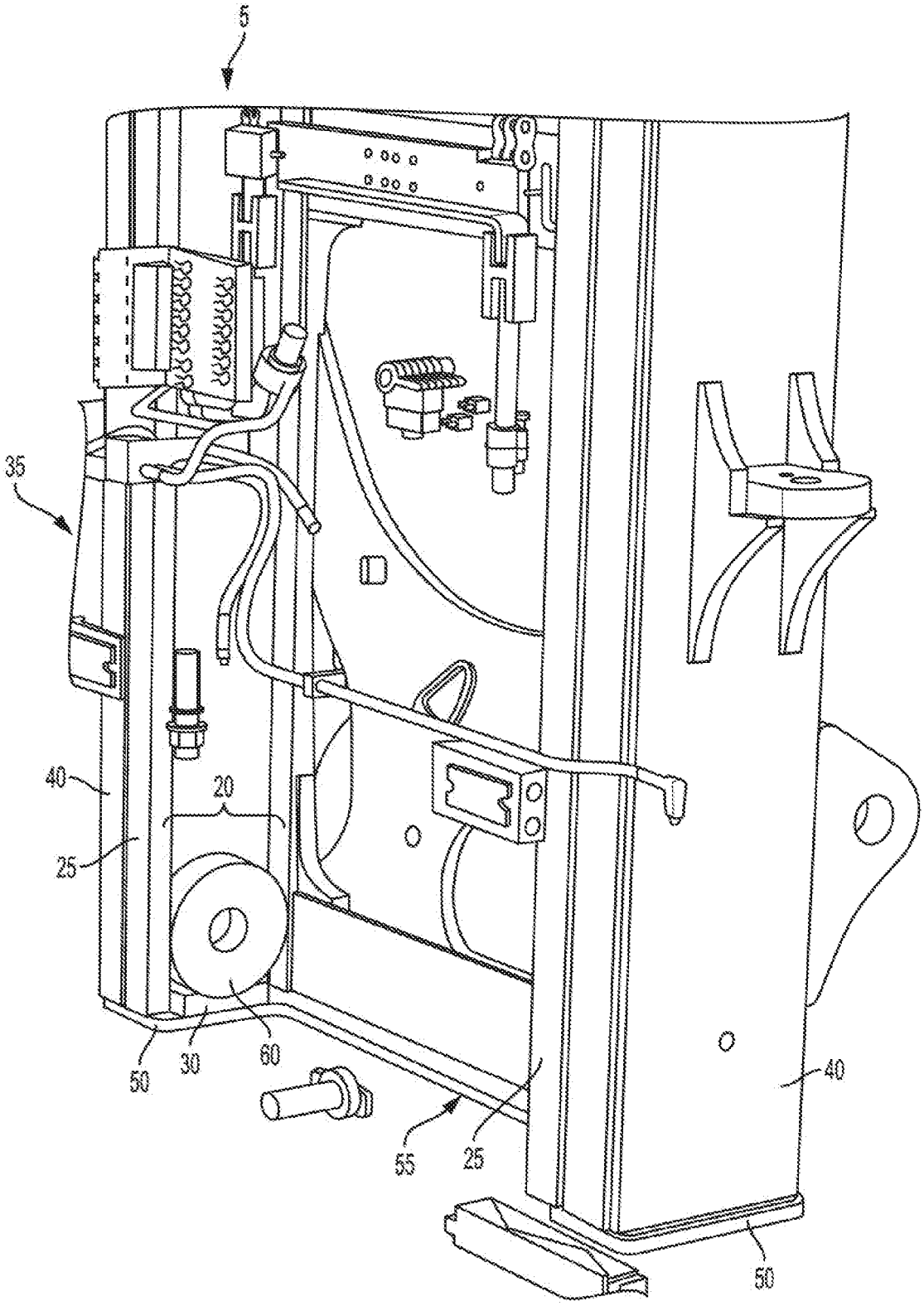
FIG. 4 is a view of the bottom portion of FIG. 1 with the inner mast stage and an attachment roller illustrated.

Impact dampening blocks 30 may be located on end caps 50 such that the impact dampening blocks 30 do not interfere with movement of the inner mast section 37. Optionally, as illustrated in FIG. 3, mast columns 25 of the inner mast section 37 contact the plate 55 without contacting the impact dampening blocks 30. The impact dampening blocks 30 are located on the end caps 50 such that each impact dampening block 30 is substantially centered within its corresponding channel 20 when the inner mast section 37 is at its fully lowered position. Such centering may locate each impact dampening block 30 to receive a roller 60 (FIG. 4). Optionally, impact dampening blocks, such as impact dampening blocks 30, may contact portions of an inner mast section, such as inner mast section 37.

Figure 4A:
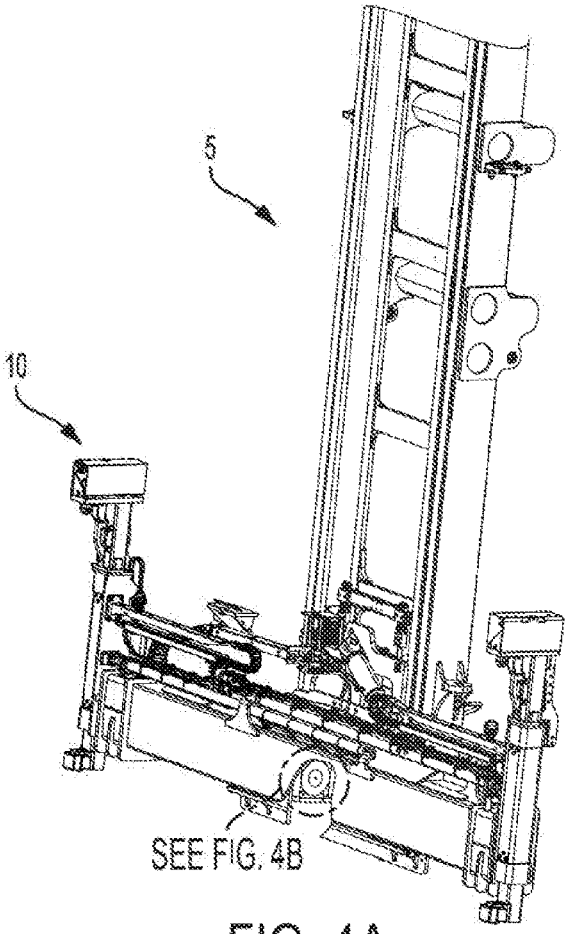
FIG. 4A is a partial cut-away view of the embodiment of FIG. 1 showing an attachment roller engaging an impact dampening block.
Figure 4B:
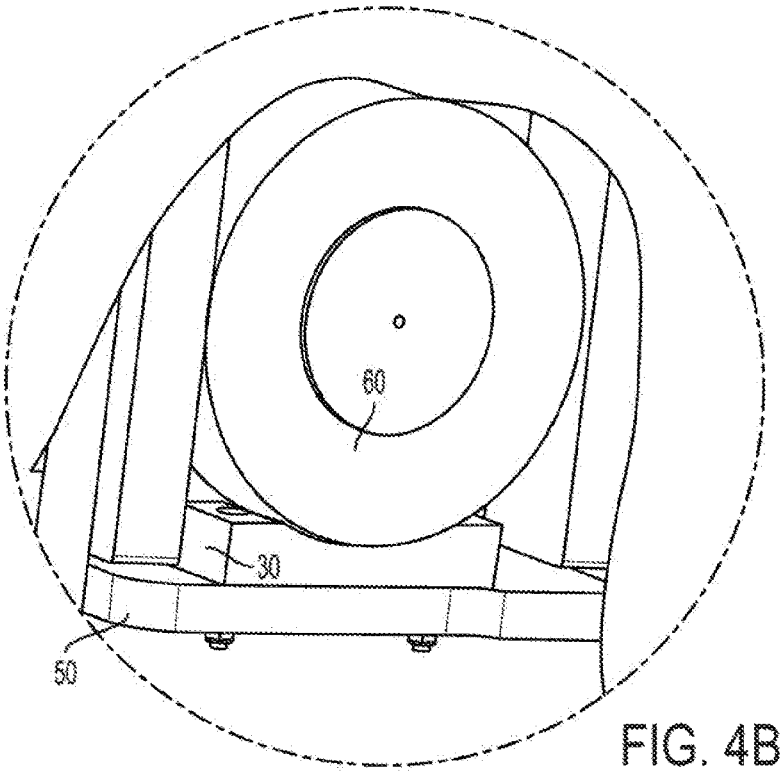
FIG. 4B is a close-up view of the attachment roller engaging the impact dampening block of FIG. 4A.
Figure 5:
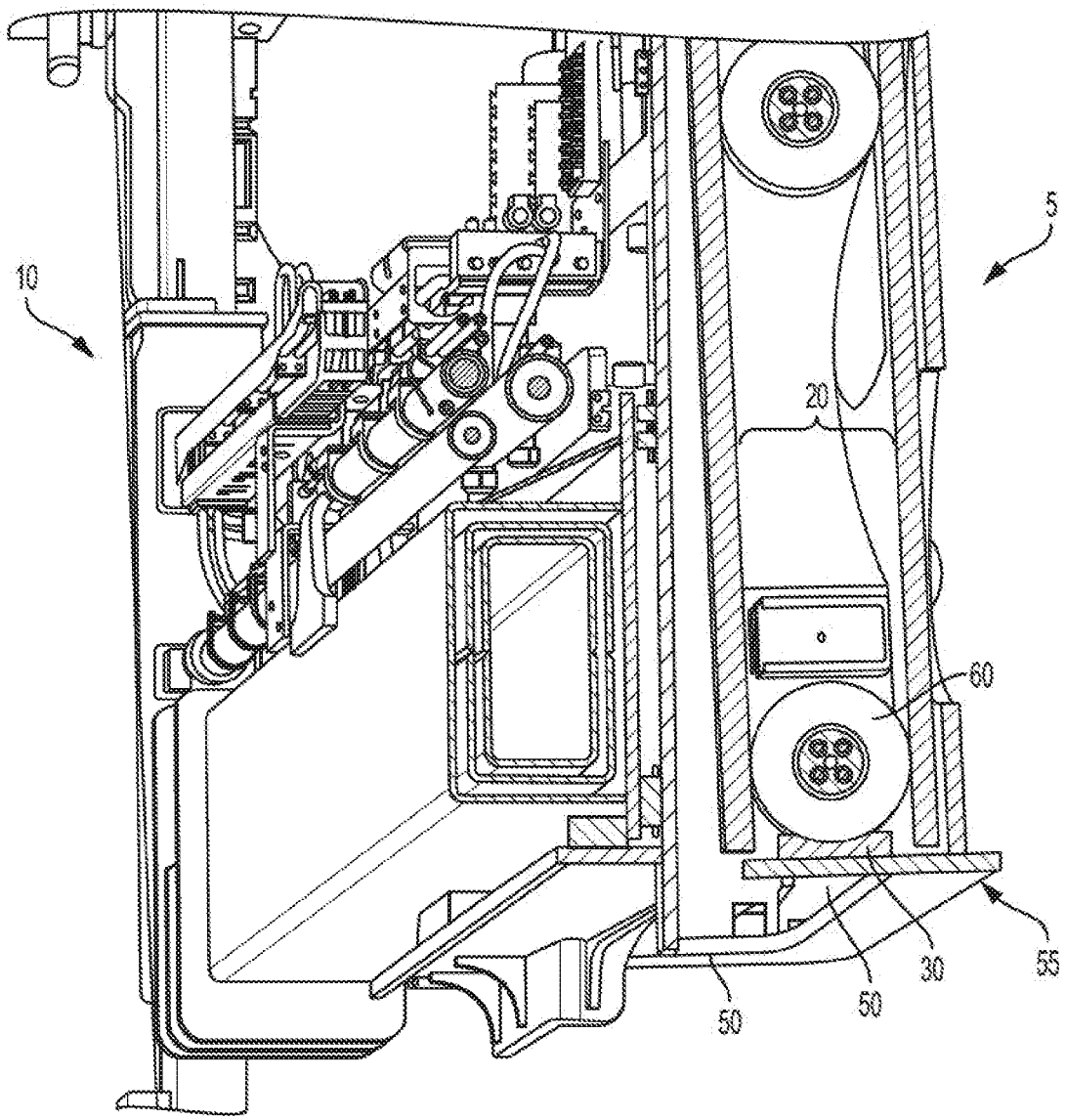
FIG. 5 is a close-up view of FIG. 1.
Figure 6:
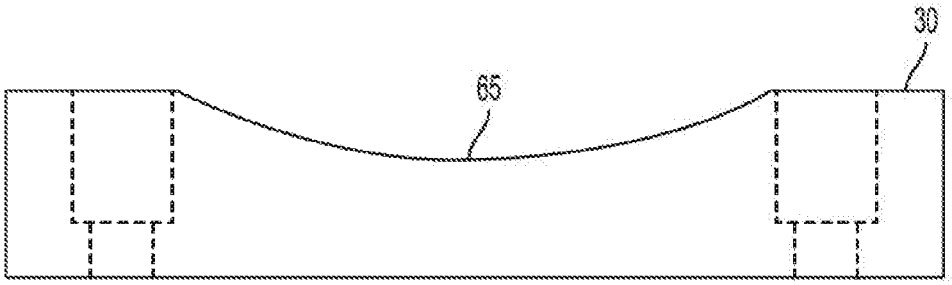
FIG. 6 is a front view of the impact dampening block of FIG. 2.
Figure 7:
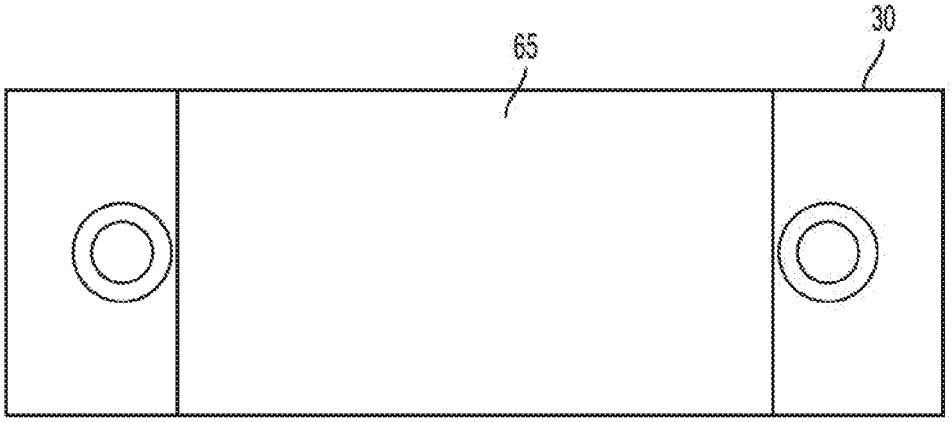
FIG. 7 is a top view of the impact dampening block of FIG. 6.

When the container handling attachment 10 is lowered, for example, as illustrated in FIGS. 4A, 4B, and 5, the rollers 60 of the container handling attachment 10 may contact the impact dampening blocks 30. For example, each impact dampening block 30 may include a cut-out 65 (FIGS. 6 and 7) that matches the outer contour of the rollers 60, which may facilitate self-centering of the rollers 60 with respect to the impact dampening blocks 30. After the rollers 60 make initial contact with the impact dampening blocks 30, the container handling attachment 10 may be further lowered such that the impact dampening blocks 30 compress, and thus receive some of the weight of the container handling attachment 10. With the impact dampening blocks 30 bearing at least some of the weight of the container handling attachment 10, the lift chain 15 has at least some of the tension removed. Thus, lowering the container handling attachment 10 onto the impact dampening blocks 30 relieves at least some of the tension from the lift chain 15.

As an example, in some embodiments container handling attachment 10 may weigh approximately 4,500 kilograms (kg). The lift chain 15 itself may weigh approximately 16.4 kg. When the impact dampening blocks 30 are bearing the weight of the container handling attachment 10, the lift chain 15 may only need to bear its own weight (i.e., approximately 16.4 kg), which may result in an approximately 99.28% reduction in weight carried by each of the two chains, which may result in a corresponding relief in tension from the lift chain 15.

As another example, in some embodiments container handling attachment may weigh approximately 6,500 kg. The lift chain 15 itself may weight approximately 26.2 kg. When the impact dampening blocks 30 are bearing the weight of the container handling attachment 10, the lift chain 15 may only need to bear its own weight (i.e., approximately 26.2 kg), which may result in an approximately 99.20% reduction in weight carried by each of the two chains, which may result in a corresponding relief in tension from the lift chain 15.

In the embodiment illustrated in FIGS. 1-5, the impact dampening blocks 30 are made of a plastic material, preferably nylon or ultra-high-molecular-weight polyethylene, have a height of approximately 40 millimeters (mm), a width of approximately 70 mm, a length of approximately 200 mm, and a cut-out 65 with a diameter of approximately 283 mm. Other suitable materials and dimensions may be used for other embodiments. In yet other embodiments, springs may be included to facilitate dampening when the moveable member contacts the impact dampening blocks, for example, coil springs may be included around bolts that hold the impact dampening block body in place.

Figure 8:
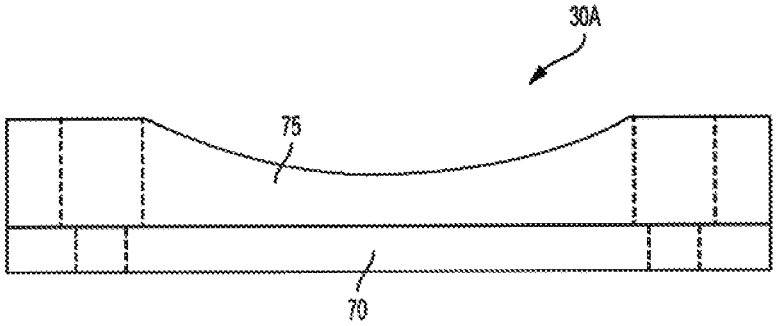
FIG. 8 is a front view of another embodiment of an impact dampening block.
Figure 8A:
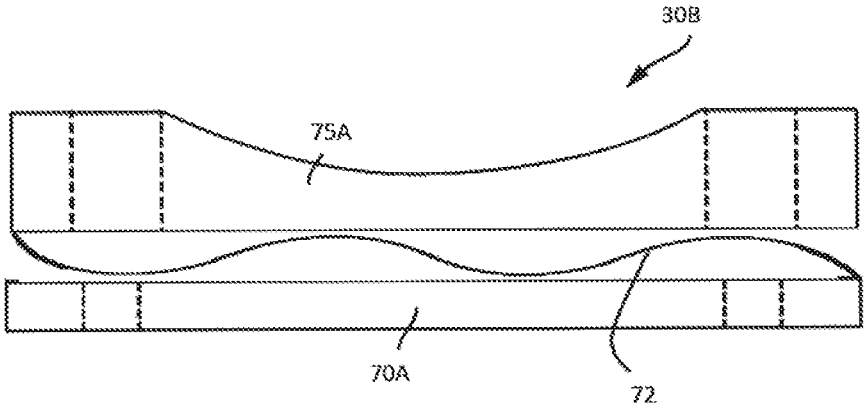
FIG. 8*a* is a view of another embodiment of an impact dampening block.

FIG. 8 illustrates an example embodiment where the impact dampening blocks 30A are a composite between a metallic section 70 and a plastic section 75. Optionally, an adhesive may be used to secure the plastic section 75 to the metallic section 70. Optionally, with reference to FIG. 8A, a spring, such as a wave spring 72, or a leaf spring (not illustrated) or coil spring (not illustrated), may be located between an impact dampening block body (such as metallic section 70A) and an end cap (such as plastic section 75A).

Figure 9:
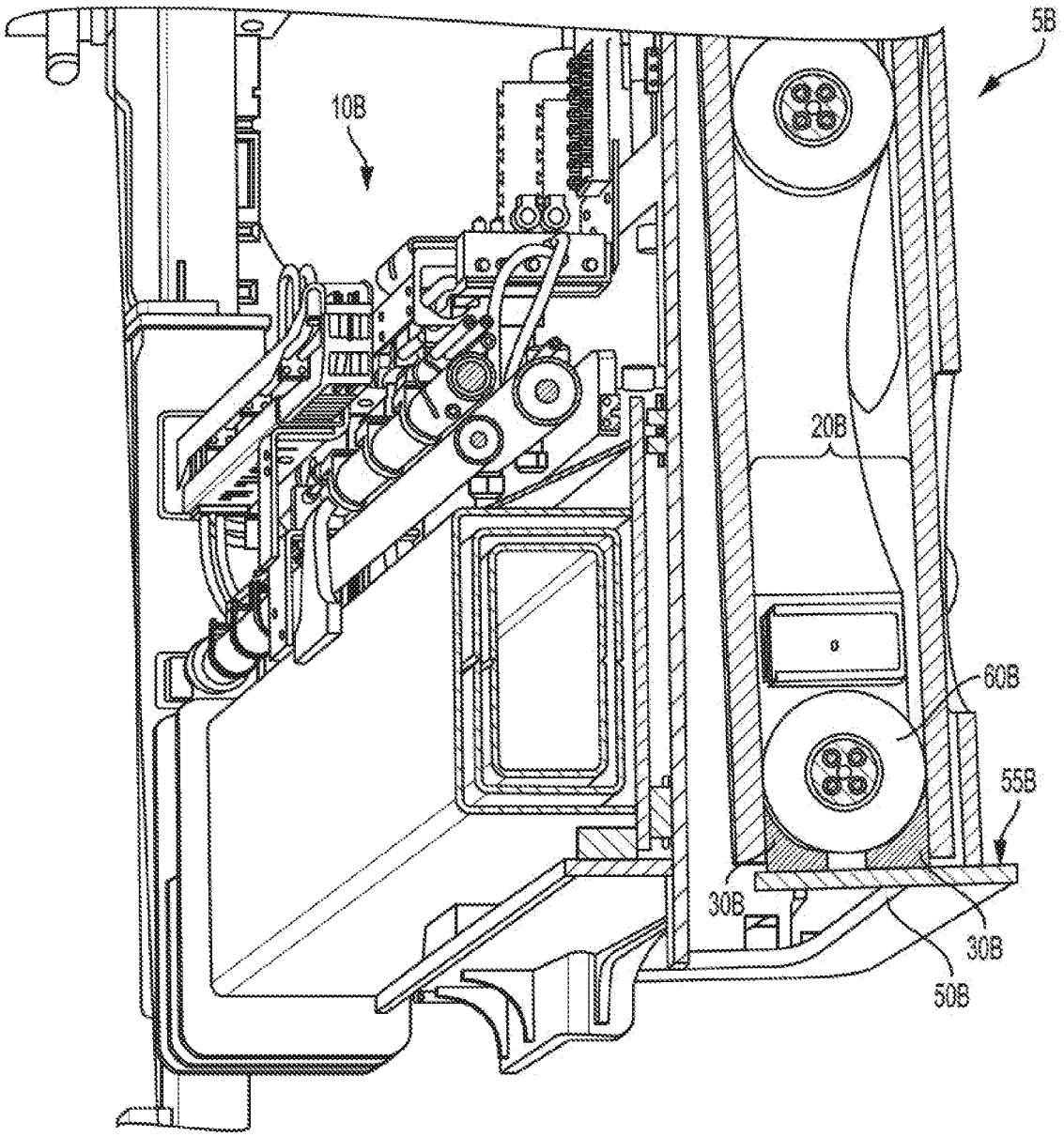
FIG. 9 is a side cut-away view of another embodiment.

FIG. 9 illustrates an alternate embodiment where the impact dampening blocks 30B may be formed from two parts that bookend a roller 60B when the roller 60B is lowered onto the impact dampening blocks 30B. Impact dampening blocks 30B are optionally attached to end caps 50B and are located such that the walls of channel 20B do not contact the impact dampening blocks 30B. Thus, at least some of the weight of a container handling attachment (not illustrated in FIG. 9) is borne by the plate 55B when the container handling attachment contacts the impact dampening blocks 30B. Other suitable shapes and arrangements may be used for form impact dampening blocks.

Figure 10:
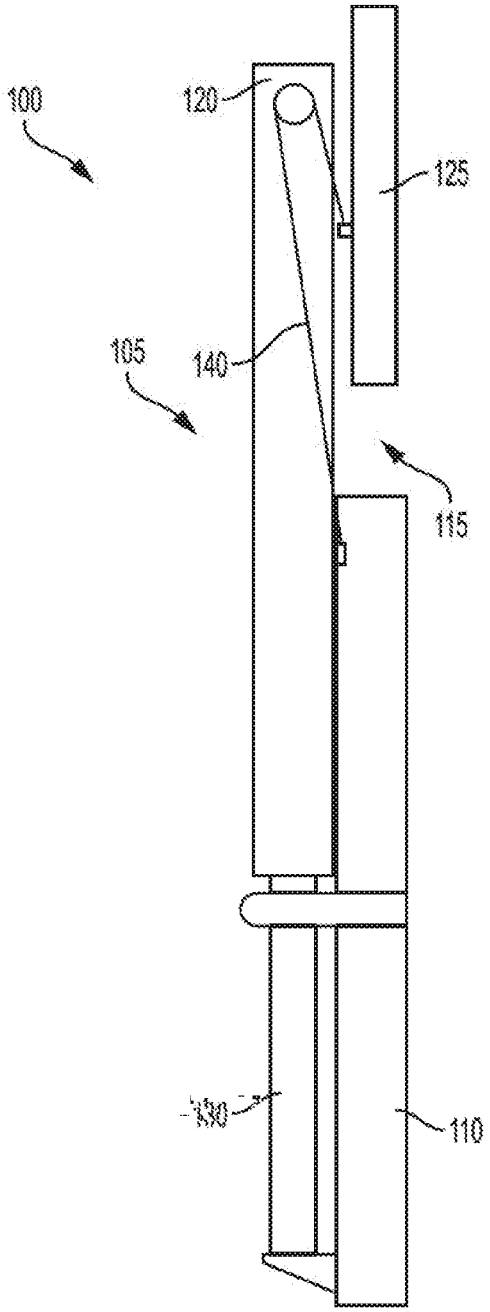
FIG. 10 is a right-side schematic illustration of another embodiment.

With reference to FIG. 10, an example two stage mast 100 that uses two sets of impact dampening blocks, such as impact dampening blocks 30, is illustrated. The outer mast stage 105 comprises two mast columns 110 (only the right mast column 110 is shown). The inner mast stage 115 comprises two mast columns 120 (only the right mast column 120 is shown). An attachment 125 is moveably attached to the inner mast stage 115. Hydraulic cylinders 130 move the inner mast stage 120 with respect to the outer mast stage 105. When the inner mast stage 115 moves with respect to the outer mast stage 105, lift chains 140 cause the attachment 125 to move with respect to the inner mast stage 115.

Just as dampening blocks 30 may be located within the footprint of channel 20 (FIG. 3), a first set of dampening blocks may be located in the footprint of channels of the mast columns 110 and a second set of dampening blocks may be located in the footprint of channels of the mast columns 120. Thus, the first set of dampening blocks may receive rollers attached to the inner mast stage 115 (which is a moveable member) when the inner mast stage 115 is lowered and its rollers engage the first set of dampening blocks. Likewise, the second set of dampening blocks may receive rollers attached to the attachment 125 (which is a moveable member) to relieve, or partially relieve, tension from lift chains 140 when the attachment 125 is lowered and its rollers engage the second set of dampening blocks.

The foregoing is a detailed description of illustrative embodiments of the invention using specific terms and expressions. Various modifications and additions can be made without departing from the spirit and scope thereof. For example, an embodiment may use wheel-chock shaped impact dampening blocks without an end cap. Therefore, the invention is not limited by the above terms and expressions, and the invention is not limited to the exact construction and operation shown and described. On the contrary, many variations and embodiments are possible and fall within the scope of the invention which is defined only by the claims that follow.

The invention claimed is:

1. A mast for a lift truck comprising a mast stage comprising a first column that has a first channel and a first channel footprint and a second column that has a second channel and a second channel footprint;

a moveable member that engages the first channel and the second channel such that the moveable member vertically translates along the mast stage via a lift chain;

a first impact dampening block secured in the first channel footprint such that a portion of the moveable member contacts the first impact dampening block when the moveable member is lowered thus facilitating release of at least some tension from the lift chain by transference of at least some of the weight of the moveable member to the first impact dampening block; and a second impact dampening block secured in the second channel footprint such that a portion of the moveable member contacts the second impact dampening block when the moveable member is lowered thus facilitating release of at least some tension from the lift chain by transference of at least some of the weight of the moveable member to the second impact dampening block.

2. A mast for a lift truck according to claim 1, further comprising:

a first end cap secured to the first column at an end of the first channel proximate the ground; and a second end cap secured to the second column at an end of the second channel proximate the ground;

wherein the first impact dampening block is secured to the first end cap and positioned in the first channel footprint; and the second impact dampening block is secured to the second end cap and positioned in the second channel footprint.

3. A mast for a lift truck according to claim 2, wherein:

the first impact dampening block is made of plastic and includes an arc-shaped cutout that matches the curvature of a roller attached to the moveable member and constrained in the first channel; and the second impact dampening block is made of plastic and includes an arc-shaped cutout that matches the curvature of a roller attached to the moveable member and constrained in the second channel.

4. A mast for a lift truck according to claim 3, wherein:
the first end cap and the second end cap are formed as part of a single plate that is attached to the end of the mast section proximate to the ground.

5. A mast for a lift truck according to claim 4, wherein:
the first impact dampening block is bolted to the first end cap; and
the second impact dampening block is bolted to the second end cap.

6. A mast for a lift truck according to claim 1, wherein:
the first impact dampening block is made of plastic and includes a first portion secured proximate to a bottom of the first channel and a second portion secured proximate to the bottom of the first channel, wherein the first portion and the second portion of the first impact dampening block are positioned and sized to bookend a first roller attached to the moveable member; and
the second impact dampening block is made of plastic and includes a third portion secured proximate to a bottom of the second channel and a fourth portion secured proximate to the bottom of the second channel, wherein the third portion and the fourth portion of the second impact dampening block are positioned and sized to bookend a second roller attached to the moveable member.

7. A mast for a lift truck according to claim 1, wherein the first impact damping block further comprises a first spring and the second impact damping block further comprises a second spring.

8. A mast for a lift truck according to claim 7, wherein:
the first impact dampening block further comprises a first block body and a first end cap, wherein the first spring is positioned between the first block body and the first end cap; and
the second impact dampening block further comprises a second block body and a second end cap, wherein the second spring is positioned between the second block body and the second end cap.

9. A mast for a lift truck according to claim 1, wherein:
the first impact damping block further comprises a first metallic section secured to a first plastic section; and
the second impact damping block further comprises a second metallic section secured to a second plastic section.

10. A mast for a lift truck according to claim 1, wherein the moveable member comprises an attachment.

11. A mast for a lift truck according to claim 1, wherein the moveable member comprises a mast stage.

12. A mast for a lift truck comprising:
a mast stage comprising a first column that has a first channel and a second column that has a second channel;
a moveable member engaged with the first channel and the second channel such that the moveable member vertically translates along the mast stage via a lift chain;
a first means for relief of lift chain tension secured in the first channel such that a portion of the moveable member contacts the first means for relief of lift chain tension when the moveable member is lowered, thereby facilitating release of at least some tension from the lift chain by transference of at least some of the weight of the moveable member to the first means for relief of lift chain tension; and
a second means for relief of lift chain tension secured in the second channel such that a portion of the moveable member contacts the second means for relief of lift chain tension when the moveable member is lowered thereby facilitating release of at least some tension from the lift chain by transference of at least some of the weight of the moveable member to the second means for relief of lift chain tension.

13. A mast for a lift truck according to claim 12, further comprising:
a first end cap secured to the first column at an end of the first channel proximate the ground; and
a second end cap secured to the second column at an end of the second channel proximate the ground;
wherein the first means for relief of lift chain tension is secured to the first end cap and positioned in the first channel footprint; and
the second means for relief of lift chain tension is secured to the second end cap and positioned in the second channel footprint.

14. A mast for a lift truck according to claim 12, wherein the first means for relief of lift chain tension further comprises a first spring and the second means for relief of lift chain tension further comprises a second spring.

15. A mast for a lift truck according to claim 12, wherein:
the first means for relief of lift chain tension is made of plastic and includes a first portion secured proximate to a bottom of the first channel and a second portion secured proximate to the bottom of the first channel, wherein the first portion and the second portion of the first impact dampening block are positioned and sized to bookend a first roller attached to the moveable member; and
the second means for relief of lift chain tension is made of plastic and includes a third portion secured proximate to a bottom of the second channel and a fourth portion secured proximate to the bottom of the second channel, wherein the third portion and the fourth portion of the second impact dampening block are positioned and sized to bookend a second roller attached to the moveable member.

16. A mast for a lift truck according to claim 12, wherein the moveable member is a mast stage.

17. A method for relieving lift chain tension comprising:
lowering a moveable member that is constrained in a first channel and in a second channel of a mast stage;
contacting a first portion of the moveable member with a first impact dampening block secured in a footprint of the first channel;
contacting a second portion of the moveable member with a second impact dampening block secured in a footprint of the second channel; and
continuing to lower the moveable member after the first portion of the moveable member contacts the first impact dampening block and after the second portion of the moveable member contacts the second impact dampening block thus facilitating releasing tension from the lift chain by transferring at least some of the weight of the moveable member to the first impact dampening block and to the second impact dampening block.

18. A method according to claim 17, further comprising:
securing the first impact dampening block at an end of the first channel proximate the ground; and
securing the second impact dampening block at an end of the second channel proximate the ground.

19. A method according to claim 17, wherein the moveable member includes an attachment.

20. A method according to claim 17, wherein the moveable member includes a mast stage.

* * * * *